United States Patent [19]

Clark et al.

[11] Patent Number: 4,859,349

[45] Date of Patent: Aug. 22, 1989

[54] POLYSACCHARIDE/PERFLUOROALKYL COMPLEXES

[75] Inventors: Kirtland P. Clark, Bethal, Conn.; Robert A. Falk, New City, N.Y.

[73] Assignee: Ciba-Geigy Corporation, Ardsley, N.Y.

[21] Appl. No.: 107,434

[22] Filed: Oct. 9, 1987

[51] Int. Cl.[4] ..... A62D 1/00; A62C 1/00; A62C 3/00

[52] U.S. Cl. ..... 252/3; 252/2; 252/8.05; 252/307; 169/44; 169/46; 169/54; 536/31; 536/55.1; 536/102

[58] Field of Search ..... 252/8.05, 2, 3, 307, 252/308, 309, 378 R, 382; 260/501.15, 501.16, 501.21, DIG. 24; 546/246, 247, 248, 340, 344; 169/44, 46, 54; 536/102, 114, 123, 31, 55.1

[56] References Cited

U.S. PATENT DOCUMENTS

| | | | |
|---|---|---|---|
| 2,759,019 | 8/1956 | Brown et al. | 260/556 |
| 2,764,602 | 9/1956 | Ahlbrecht | 260/404.5 |
| 2,764,603 | 9/1956 | Ahlbrecht | 260/404.5 |
| 3,207,730 | 7/1964 | Guenthner | 260/DIG. 24 |
| 3,257,407 | 10/1965 | Brace | 260/501.12 |
| 3,350,218 | 4/1965 | Gagliardi | 260/501.12 |
| 3,510,494 | 5/1970 | Gagliardi | 260/295 |
| 3,681,441 | 8/1972 | Robertson | 424/329 |
| 3,759,981 | 9/1973 | Hager et al. | 252/356 |
| 3,849,315 | 11/1974 | Chiesa, Jr. | 252/3 |
| 3,915,800 | 10/1975 | Kang et al. | 195/96 |
| 3,933,819 | 1/1976 | Toukan et al. | 260/251 |
| 3,957,657 | 5/1976 | Chiesa, Jr. | 252/3 |
| 3,957,658 | 5/1976 | Chiesa, Jr. et al. | 252/3 |
| 4,038,195 | 7/1977 | Chiesa, Jr. | 252/3 |
| 4,042,522 | 8/1977 | Falk | 252/8.05 |
| 4,060,489 | 11/1977 | Chiesa, Jr. | 252/3 |
| 4,098,811 | 7/1978 | Falk | 252/8.05 |
| 4,137,251 | 1/1979 | Berger | 260/458 |
| 4,151,302 | 4/1979 | Gante et al. | 424/317 |
| 4,271,321 | 6/1981 | Voges | 568/569 |
| 4,306,979 | 12/1981 | Tsuji | 252/3 |
| 4,387,032 | 6/1983 | Chiesa, Jr. | 252/3 |
| 4,404,377 | 9/1983 | Seale et al. | 544/87 |
| 4,420,434 | 12/1983 | Falk | 252/8.05 |
| 4,424,133 | 1/1984 | Mulligan | 252/8.05 |
| 4,430,272 | 2/1984 | Ehrl et al. | 252/8.05 |
| 4,464,267 | 8/1984 | Chiesa, Jr. et al. | 252/8.05 |
| 4,472,286 | 9/1984 | Falk | 252/8.05 |
| 4,618,686 | 10/1986 | Boyer | 549/360 |

*Primary Examiner*—Howard I. Locker

*Attorney, Agent, or Firm*—JoAnn Villamizar; Irving M. Fishman

[57] ABSTRACT

The instant invention relates to water-soluble anionic polysaccharides bound to perfluoroalkyl cationic surfactants. Polymer complexes are formed which are especially useful for fighting fires of hydrophilic or polar liquids. They have the unique property of forming an impervious gel when foamed with suitable surfactants and projected onto burning liquids. The gelatinous blanket is resistant to the fuel and protects the foam blanket from destruction. Consequently, superior fire-fighting agents can be prepared for fires which are otherwise very difficult to extinguish.

8 Claims, No Drawings

POLYSACCHARIDE/PERFLUOROALKYL COMPLEXES

BACKGROUND OF THE INVENTION

Polymer/surfactant pairs in which the polymer is a polyion and the surfactant is ionic but bears the opposite charge are well known. When the respective charges are of the same sign association between the polymer and surfactant is feeble or absent while with oppositely charged systems the association complex is strong since very strong forces of electrical interaction are involved. A common application of such complexes is the use of cationic polyelectrolytes as flocculants in water purification.

Polysaccharides are hydrophilic carbohydrate polymers of high molecular weight composed of monosaccharide units joined by glycosidic bonds. They are obtained from land or sea sources or by microbiological means and are generally considered to have ten or more monosaccharide units. The units may be of one monosaccharide type but more often are comprised of up to six types of sugar units. They are frequently described from the standpoint of their sources as: phytoglycans, bacterial and fungal polysaccharides, or zoopolysaccharides. Almost half of known polysaccharides are anionic and contain uronic acid residues, though other acid groups such as sulfate phosphate or pyruvate may be present.

Complexes of the abundant anionic polysaccharides are the subject of this application.

Polymer-surfactant interactions have been reviewed by E. D. Goddard in Colloids and Interfaces, 19, 255–329 (1986). It has been shown in several instances that the addition of an "equivalent" amount of charged surfactant to a counter-charged polymer results in a stoichiometric precipitate separating from the aqueous solution. The interaction has been studied by turbidity or change in surface tension or conductance. Although redissolution of the bound complex can occur at low concentration it is unlikely to occur if the charge density of the polymer is very high. It is also highly dependent on the surfactant structure and the complex is generally quite insoluble at higher concentrations. Generally the formation of such precipitates is a "nuisance." We have unexpectedly found the particular fluorochemical complexes described herein are of particular usefulness of virtue of their insolubility and imperviousness to organic liquids.

Kwak and his co-workers cited in Goddard (Ref. 30–37) have shown that the binding affinity of a cation to various polyanions varies considerably with the polyanion: Sodium dextran sulfate>alignate>>pectate>-sodium carboxymethylcellulose. Further, the surfactant head group is also important and it was found that the alkylpyridinium group was more tightly bound than alkyltrimethylammonium. Of considerable importance for reasons claimed in this patent, the properties of the charged polymer are substantially changed by the adsorption process.

Studies with a number of surfactants show polymer/-surfactant interactions are most favorable (a) the longer the hydrocarbon chain, (b) the straighter the chain, and (c) when the head group is terminal to the chain.

The binding of certain anionic polysaccharides to alkylpyridinium cations is described by A. Malovikova and K. Hayakawa in Structure/Performance Relationships in Surfactants by M. Rosen, ACS Symposium Series 253, American Chemical Society, 1984.

The binding of anionic polysaccharides to perfluoroalkyl containing cations has not been previously described and such complexes form the basis for this invention.

Any polysaccharides containing anionic groups are useful for purposes of this invention.

The use of polysaccharides to extinguish fires has been described in U.S. Pat. Nos. 3,849,315, 3,957,657, 3,957,658, 4,038,195, 4,042,522, 4,060,132, 4,060,489, 4,149,599, 4,306,979, 4,387,032, 4,420,434, 4,424,133, 4,464,267, 4,472,286. Such fire-fighting compositions may also contain fluorochemical surfactants, fluorochemical synergists, hydrocarbon or silicone surfactants, buffers, corrosion inhibitors, chelating agents, antimicrobial agents, solvents, electrolytes, polymeric foam stabilizers, viscosity reducers and pour point depressants.

The fighting of fires on hydrophilic liquids such as methanol, acetone, and the like is more difficult than the fighting of fires on hydrophobic liquids. Aqueous foams are considered the most desirable material for fighting fires on large bodies of such flammable liquids and thixotropic polysaccharide containing compositions are known to form a gelatinous mat above such burning liquids. The mat floats on the burning fuel and protects the foam above it so the fire is rapidly extinguished.

Prior-art compositions describe the use of various types of polysaccharides including heteropolysaccharide 7 described in U.S. Pat. No. 3,915,800 as well as its degraded forms, scleroglucan, mannan gum, xanthan gum, phosphomannon Y-2448, polysaccharide Y-1401, or virtually any water-soluble thixotropic polysaccharide having at least 100 glycose units, or a mol. weight of at least 18,000. Scleroglucan is preferred in U.S. Pat. No. 4,060,132. Locust bean gum, a galoctamannan is also suggested, as is Kelco K8A13, a high molecular weight anionic heteropolysaccharide of formula $[C_{107}H_{158}O_{190}K_5]_n$ sold by Kelco, San Diego, CA. Suggested too are alginates, alginic and polyglycol esters, pectin, gum arabic, carboxymethyl starch, starch and Actigum CX9 (Ceca S.A., Elf Aquitane, France).

Perfluoroalkyl anion/perfluoroalkyl cation ion-pair complexes have been described in compositions for fighting polar or non-polar solvent fires in U.S. Pat. Nos. 4,472,286 and 4,420,434.

It has now been found that the insoluble polymer complex formed from anionic polysaccharides and perfluoroalkyl cations are much more effective than the polysaccharides used in prior-art fire fighting compositions, will (a) reduce costs due to the use of smaller amounts of fluorochemicals and polysaccharides and (b) will increase the fire-fighting efficiency of such extinguishing agents.

DETAILED DISCLOSURE

The instant invention relates to anionic polysaccharide/perfluoroalkyl surfactant cation complexes of approximately equivalent charge stoichiometry. The polysaccharides contain anionic groups, generally but not limited to carboxyl; the fluorochemical cation contains cationic groups, generally but not limited to ammonium, and a perfluoroalkyl group having 4 to 18 carbon atoms.

Anionic polysaccharides belong to a known class of materials and are described, for example, in Vol. 11 (2nd Edition), pp. 396–424; and Vol. 15 (3rd Edition), pp 439–445 of Kirk-Othmer Encylopedia of Chemical Technology (John Wiley and Sons), NY. Perfluoroalkyl surfactant cations useful for purposes of this invention also belong to a known class and preferably have the formula:

$$R_f—A—\overset{\oplus}{N}R_1R_2R_3 \quad (I)$$

wherein $R_f$ represents a straight or branched chain perfluoroalkyl or perfluoroalkoxy-substituted perfluoroalkyl of 4 to 18 carbon atoms;

A represents a divalent covalent linking group of unrestricted structure, but is preferably a straight or branched substituted or unsubstituted aliphatic chain of 1 to 18 atoms and may contain, for example, sulfide, sulfone, sulfoxide, trivalent nitrogen atoms bonded only to carbon atoms, such as amino or a lower aliphatic grooup substituted amino carbonyl, sulfonamido, carbonamido, arylene groups and the like and may be a direct bond;

$R_1$, $R_2$ and $R_3$ are independently hydrygen, aryl of 6 to 10 carbon atoms or an aliphatic or araliphatic group of up to 50 carbon atoms, and is preferably hydrogen, phenyl or alkyl of 1 to 8 carbon atoms which are unsubstituted or substituted by for example, halo, hydroxy or aryl, $(CHR_4CH_2O)_yR_5$ where y is 1 to 20, $R_4$ is hydrogen or alkyl of 1 to 4 carbon atoms, $R_5$ is hydrogen or methyl, or $R_1$ and $R_2$ taken together with the nitrogen to which they are attached represent piperidino, morpholino, or piperazino; or wherein $R_1$, $R_2$ and $R_3$ taken together with the nitrogen to which they are attached represent pyridinium, or substituted pyridinium

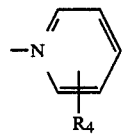

A preferred class of complexes are those of the above formula wherein $R_f$ is perfluoroalkyl of 4 to 12 carbon atoms;

A represents a divalent covalent linking group of up to 20 carbon atoms of the formula $$—(G)_n\text{alkylene}—(G'\text{-alkylene})_{n_2}(G''\text{-alkylene})_{n_3}$$

wherein

G, G' and G'' independently represent —O—, —S—, $—SO_2—$, $—SO_2NH—$, $$—CONH—,\ —\overset{O}{\overset{\|}{C}}—,\ —\overset{OH}{\overset{|}{CH}};\ \text{or}\ —\overset{|}{C}—CH_2OH$$

n is 0 or 1;

$n_2$ and $n_3$ are independently 0, 1 or 2;

alkylene is straight or branched chain alkylene of 1 to 8 carbon atoms, and A additionally represents a direct bond; and $R_1$, $R_2$, and $R_3$ are lower alkyl.

Highly preferred are those within said preferred class wherein $R_f$ is perfluoroalkyl of 4 to 12 carbon atoms; A is of the formula $$—CH_2CH_2—\text{S-alkylene-G'-alkylene-}$$

wherein G' is $$—\overset{OH}{\overset{|}{CH}}— \text{ or } —\overset{|}{C}—CH_2OH$$

and alkylene is straight or branched chain of from 1 to 6 carbon atoms, $R_1$, $R_2$, $R_3$ are methyl.

Preferred anionic polysaccharides are those containing carboxyl, sulfonic, sulfato, phosphonic, or phosphato anionic groups.

The carboxyl groups in naturally occurring anionic polysaccharides are frequently derived from D-glucuronic acid, as in pectic acid, which is a linear polymer of the acid. Alginic acid is a copolymer of mannuronic and guluronic acids; derimaten contains L-iduronic acid; heparin contains sulfated hydroxyl groups.

Microbial polysaccharides are produced extracellularly by microorganisms grown under rigidly controlled conditions. The anionic heteropolysaccharide grown from Xanthomonas campestris is called xanthan gum; it contains ionizable carboxyl groups from D-glucuronic acid residues as well as a pyruvic acid acetal residues. A commercial process has been described for the production of gum with a high (4%) pyruvic acid content. It is believed that the final product is actually a mixture of high and low pyruvate types since different acid contents can be obtained by fractional precipitation in alcohol. The pyruvate acetal content is sensitive to variant substrains of the Xanthomonas campestris culture. Further, dispersions of gum with 4–4.8% pyruvate are more viscous than gum of 2.5–3.0% and the strains and fermentation conditions must be carefully controlled.

Trade names of some of these gums are - Rhodapol, Kelco, Actigum, Cecalgum and Kelzan. The structure of many gums has not been determined and is not critical for purposes of this invention. It merely suffices that acidic residues are present in the gum which can complex to cationic sites. Gums and substances useful for purposes of this invention, which have such acidic residues, are:

Xanthan, Pectic acid, Alginic acid, Agar, Carrageenan, Mannan gum, Phosphamannan Y2448, Polysaccharide Y-1401, Locust bean gum, Galactomannan, Kelco K8A13, Alginic acid polyglycol esters, Pectin, Starch, Actigum CX9, Zanflo, Beijerinckia indica, Agarlike, Bacterial alginic acid, Succinoglucan, Gum arabic, Carboxymethylcellulose, Heparin, Phosphoric acid polysaccharides, Dextran sulfate, Dermatan sulfate, Fucan sulfate, Gum karaya, Gum tragacanth, Sulfated lowest bean gum.

The polysaccharides are considered anionic if they contain as little as 0.5% by weight carboxyl groups or equivalent acidic funtion, e.g sulfato, sulfanato, or phosphato. They should be soluble in water at 0.01% by weight and contain ten or more monosaccharide residues.

The $R_f$/polysaccharide complexes are useful for purposes of this invention if they are insoluble in isopropanol above about 0.05% by weight.

The synthesis of the $R_f$/ polysaccharide complexes can be carried out in several ways.

Generally the perfluoroalkyl surfactant cations of formula (I) correspond to the cation of perfluoroalkyl cationic surfactants of the formula $$R-A-\overset{\oplus}{N}R_1R_1R_3\overset{\ominus}{X} \qquad (II)$$

where $R_f$, A, $R_1$, $R_2$ and $R_3$ are as defined above and X is an anion. X is preferably in the form of an aqueous solvatable anion such as the halide, lower alkyl sulfate or sulfonate, or hydroxide. Preferred halides include the chloride, bromide and iodide and a preferred lower alkyl sulfate is the methyl sulfate.

One method consists of reacting equimolar amounts of concentrated aqueous solutions of the respective cationic surfactant and the polysaccharide. The complexes will precipitate from the aqueous solutions and can be filtered, washed and dried. This method yields the complexes in solid form, substantially free from (a) trace amounts of unreacted surfactant or polysaccharide and (b) free from salts formed during the reaction. This method suffers the serious disadvantage that the product is dehydrated and very difficult to wet and redisperse in solution.

In a sub-embodiment of this method, the perfluoroalkyl cationic surfactant is in the salt form, e.g. where X in formula II is a halide, lower alkyl sulfate or sulfonate or the like, and the anionic polysaccaride is also in its salt form, such as the alkali metal, alkaline earth metal, ammonium or solvatable amine salt form. In an alternate sub-embodiment, the perfluoroalkyl cationic surfactant is in its base form, e.g. X in formula II is hydroxy, and the anionic polysaccaride is in its acid form.

A second "in-situ" method is to react equimolar amounts of the respective ingredients in a solvent-water mixture. It was found that in a preferred solvent-water mixture stable solutions of the novel complexes can be obtained which have shown to possess good stability. This method of synthesis is a preferred method if removal of (a) unreacted surfactants, surfactant precursors, excess anionic polysaccharide and (b) removal of the salt formed during the reaction is not necessary. It was also found that blending the complex solutions with other micelle forming surfactants also prevents precipitation.

A third "in-situ" method involves the reaction of cationic $R_f$-surfactants and anionic polysaccharides in which either component is present in higher than equimolar amount. As a result the complex will be formed and will have increased solution stability even if diluted to lower concentrations with water. Instead of carrying out of the above described reaction with an excess amount of either ingredient, it is also possible to carry out the action with equimolar amounts in the presence of sufficient amounts of a micelle forming nonionic or amphoteric surfactant in order to prevent precipitation of high solid content solutions upon dilution with water.

A fourth method, ideal for laboratory purposes, yielding very pure complexes is based on the reaction in a dialysis cell. By selecting the proper dialysis membranes, unreacted surfactant, precursors and salts formed during the complex formation as well as solvents will diffuse through the membrane, leaving analytically pure complexes as precipitates or solutions in the dialysis cell.

The above four methods can be carried out under conditions known, per se. Thus, the reaction temperature can vary between 0° C. to about 100° C., preferably between about 10° C. and about 40° C., in aqueous or aqueous/organic solvent media.

The individual cationic fluorochemical surfactants which may be used to make the complexes are known compounds, per se, and a number of useful cationic, fluorochemical surfactants are sold commercially by the following companies under the following trade names:

Asahi glass (Surflon S); Bayer (FT-Typen); CIBA-GEIGY (LODYNE); Dainippon Inc. (Magafac); DuPont (Zonyl); Hoechst (Licowet, Fluorwet); Neos (Ftergent); Tohaku Hiryo (F-Top); Ugine-Kuhlman (Forofac); 3M (Fluorad).

The individual anionic polysaccharides which are used to make the $R_f$-cationic/anionic polysaccharide complexes are known compounds per se, and a number of useful anionic polysaccharides are sold commercially by the following companies under the following trade names:

Kelco Inc. (Kelco, Kelzan), Ceca S.A., Elf Aquitane (Actigum), Rhone-Poulenc Inc (Rhodopol), Henkel Corp. (Galaxy XB), Pfizer.

Illustrative examples of cationic fluorochemical surfactants used for the synthesis of the instant complexes are disclosed in the following patents and are herein incorporated by reference in toto:

U.S. Pat. Nos. 2,759,019, 2,764,602; 2,764,603, 3,147,064; 3,146,066; 3,207,730; 3,257,407; 3,350,218; 3,510,494; 3,681,441; 3,759,981; 3,933,819; 4,098,811 and 4,404,377.

An alternate embodiment of the present invention relates to aqueous fire fighting compositions containing an effective polar solvent fire inhibiting amount of anionic polysaccharide/perfluoroalkyl surfactant cation complex. Such compositions characteristically also contain conventional aqueous foam adjuvants. Typical foam adjuvants include one or more of the following: surfactant, surfactant synergist, solvents, electrolytes, protein, and thickeners.

Commercial fire fighting agents primarily used today are so-called 6% or 3% proportioning systems. This means that 6 or 3 parts of the agent are diluted (proportioned) with 94, or 97 parts of water (fresh, sea, or brackish water) and applied by conventional foam making equipment. Preferred concentrates based on the novel $R_f$/polysaccharide complexes useful for 6 or 3% proportioning comprise the following components, numbered A through J:

A. 0.1 to 10% by weight of $R_f$/polysaccharide complex,

B. 0 to 5% by weight of $R_fR_f$ion-pair complex of the type described in U.S. Pat. No. 4,420,434, C. 0 to 25% by weight of nonionic, amphoteric, anionic or cationic fluorochemical surfactants, D. 0 to 5% by weight of a fluorochemical synergist, E. 0 to 40% by weight of a hydrocarbon surfactant, F. 0 to 40% by weight of a water miscible solvent, G. 0 to 5% by weight of an electrolyte, H. 0 to 10% by weight of protein or other polymeric foam stabilizer, I. 0 to 4% by weight of fluorinated oligomers as described in U.S. Pat. No. 4,460,480, J. Water in the amount to make up the balance of 100%.

Each component A through I may consist of a specific compound or mixtures of compounds.

When diluted with water very effective fire-fighting formulations are formed which deposit a tough, solvent impervious film over the surface of the flammable liquid which prevents its further vaporization and thus extinguishes the fire. The film is comprised of the subject $R_f$/polysaccharide complex which is inherently resistant to the fuel and prevents its vaporization and combustion. It further provides improved "Burnback" of the foam blanket by separating it effectively from the fuel vapors and flame front.

It is preferred for flammable solvent fires, particularly polar solvents of variable water solubility, in particular for:

Polar solvents of low water solubility—such as butyl acetate, methyl isobutyl ketone, butanol, ethyl acetate, and Polar solvents of high water solubility - such as methanol, acetone, isopropanol, methyl ethyl ketone, ethyl cellosolve and the like.

EXPERIMENTAL PART

The following examples are illustrative of various representative embodiments of the invention, and are not to be interpreted as limiting the scope of the appended claims. In the examples all parts are by weight unless otherwise specified.

PREPARATIN OF ANIONIC POLYSACCHARIDE/CATIONIC FLUOROSURFACTANT COMPLEXES

One grame of an anionic polysaccharide was dissolved in 200 ml water, neutralized if acidic, and treated with 3 g of cationic fluorosurfactant dissolved in 500–1000 ml water. The polysaccharide solution was slowly mixed into the surfactant solution with stirring for 30 minutes and any large fibrous clumps were broken up in a Waring blender at low speed. the precipitate was collected by vacuum filtration, washed thoroughly with water and isopropanol until the wash water showed very little surface tension depression then dried in a vacuum oven at 50° C. for 24 hours; it was then weighed to determine the yield, ground into powder or chopped finely, and submitted for microanalysis.

LABORATORY TEST METHOD FOR FIRE-FIGHT PERFORMANCE

Simplified concentrates simulating fire-fighting concentrates were prepared as follows: 84 g water, 5 g dodecyldimethylamine oxide and 10 g butyl carbitol were added and, with stirring, 1 g of a powdered polysaccharide was slowly added. The concentrate was mixed thoroughly and neutralized if acidic. Next, a 0.2% active aqueous solution of each perfluoroalkyl surfactant were prepared, and neutralized if acidic.

Fifteen grams of the concentrate and 15 g of a surfactant solution were diluted to 250 ml with tap water and stirred well to make a 5% w/v final working dilution.

100 ml of the 6% solution were drawn into the foam generator and discharged into a 1000 ml graduated cylinder; the foam volume was noted, and also the time required for 25 ml liquid to drain. The foam volume divided by the volume of original solution (100 ml) is termed the "Foam Expansion Ratio" (FXR). The time required for 25% of original solution volume to be recovered is called the "Quarter Drain Time" (QDT); it is a measure of the static stability of the foam.

Finally, 75 ml of 67% dilution were drawn into the foam generator and the foam discharged, through a glass guide tube, onto 250 ml 2-propanol held in a 25 cm × 16 cm glass pan. The time required for 50% of the foam area to collapse on the alcohol was recorded; this value is termed the "Foam Life" (FL) and it indicates the foam stability on polar solvents. In addition to these three measurements, the appearance of any flocculation in the dilution was reported.

TABLE 1

| FLUORINATED CATIONIC SURFACTANTS USED IN EXAMPLES 1–26 | |
|---|---|
| A1 | $C_8F_{17}SO_2NHC_3H_6\overset{+}{N}(CH_3)_3\overset{-}{Cl}$ |
| A2 | $C_8F_{17}SO_2NHC_3H_6\overset{+}{N}(CH_3)_2C_2H_5\ \overset{-}{O}SO_2OC_2H_5$ |
| A3 | $C_8F_{17}CH_2CH_2SCH_2\overset{+}{C}H(CH_3)\overset{-}{C}ONH(CH_2)_3\overset{+}{N}(CH_3)_2C_2H_5\ \overset{-}{O}SO_2OC_2H_5$ |
| A4 | $C_7F_{15}CONHC_3H_6\overset{+}{N}(CH_3)_3\overset{-}{Cl}$ |
| A5 | $C_8F_{17}SO_2NHC_3H_6\overset{+}{N}(CH_3)_2CH_2C_6H_5\overset{-}{Cl}$ |
| A6 | $C_8F_{17}SO_2N(CH_3)C_3H_6\overset{+}{N}(CH_3)_3\ \overset{-}{I}$ |
| A7 | 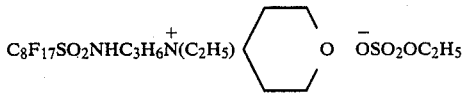 |
| A8 | $C_6F_{13}CH_2CH_2SCH_2CH_2\overset{+}{N}(CH_3)_3\ \overset{-}{I}$ |
| A9 | $C_6F_{13}CH_2CH_2SCH_2CH(OH)CH_2\overset{+}{N}(CH_3)_3\overset{-}{Cl}$ |
| A10 | $C_8F_{17}CH_2CH_2SCH_2CH(OH)CH_2\overset{+}{N}(CH_3)_3\overset{-}{Cl}$ |

TABLE 1-continued

| FLUORINATED CATIONIC SURFACTANTS USED IN EXAMPLES 1-26 | |
|---|---|
| A11 | $C_8F_{17}CH_2CH_2SCH_2CH_2OCH_2CH_2\overset{+}{N}(CH_3)_3\ I^-$ |
| A12 | $(CF_3)_2CFO(CF_2)_4CONH(CH_2)_3\overset{+}{N}(CH_3)_3\ I^-$ |
| A13 | $(CF_3)_2CFO(CF_2)_6CH_2CH_2-\overset{+}{N}$ 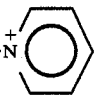 sulfate |
| A14 | $C_7F_{15}(CH_2)_5\overset{+}{N}H_3Cl^-$ |
| A15 | $C_8F_{17}CH_2CH_2-\overset{+}{N}$ 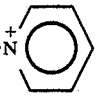 $I^-$ |
| A16 | $C_8H_{17}SO_2N(C_2H_4)_4CH_2CH_2\overset{+}{N}(CH_3)_3$ halide<br>Pr |
| A17 | $C_8F_{17}CH_2CH_2O_2CCH{=}CHCONH(CH_2)_3\overset{+}{N}(CH_3)_3\ I^-$ |
| A18 | $C_7F_{15}CH_2CH_2SCH_2CHMeCO_2(CH_2)_2\overset{+}{N}(CH_3)_3\ I^-$ |
| A19 | $C_8F_{17}CH(OH)CH_2\overset{+}{N}(Et)_2Me\ I^-$ |
| A20 | $C_8F_{17}SO_2NHC_3H_6\overset{+}{N}(CH_3)_3\ I^-$ |
| A21 | $R_fCH_2CH_2SCH_2CH_2\overset{+}{N}(CH_3)_3\quad CH_3SO_4^-$;<br>wherein $R_f$ is $F(CF_2CF_2)_{3-8}$ |

TABLE 2

| OTHER FLUORINATED AND HYDROCARBON SURFACTANTS USED IN EXAMPLES 1-26 | |
|---|---|
| B1 | $C_8F_{17}CH_2CH_2SCH_2CH(OH)CH_2O(CH_2CH_2O)_7CH_3$ |
| B2 | $CF_3(CF_2)_{2-7}CH_2CH_{78\ 2}SCH_2CH_2CO_2Li$ |
| B3 | $C_8F_{17}SO_2N(Et)CH_2CO_2K$ |
| B4 | N—[3-dimethylamino)propyl]-2 and 3-(1,1,2,2-tetrahydro-perfluoroalkylthio) succinamic acid |
| B5 | $C_8F_{17}CH_2CH_2SCH_2CH_2CONHC(CH_3)_2CH_2SO_3Na$ |
| B6 | $C_{12}H_{25}N(CH_3)_2O$ |
| B7 | $C_{12}H_{25}(CH_2CH_2COOH)\ (CH_2CH_2CO_2Na)$ |
| B8 | Dimethyldicocoammonium chloride |
| B9 | Octylphenoxy polyethoxy (16) ethanol |
| B10 | Octylphenoxy polyethoxy (30) ethanol |

TABLE 3

| FLUORINATED OLIGOMERS USED IN EXAMPLES 1-26 |
|---|
| A distribution of oligomers which are essentially: |
| $C_1$ - $C_6F_{13}CH_2S(CH_2CH(CONH_2))_5H$ |
| $C_2$ - $C_8F_{17}CH_2CH_2S(CH_2CH(CONH))_{15}H$ |
| $C_3$ - $C_{10}F_{21}CH_2CH_2S(CH_2CH(CONH_2))_{20}H$ |
| $C_4$ - $C_{12}F_{25}CH_2CH_2S(CH_2CH(CONH_2))_{25}H$ |

TABLE 4

| POLYSACCHARIDES USED IN EXAMPLES 1-10 | |
|---|---|
| P1 | Alginic Acid - Fluka - a mixed polymer of mannuronic and glycuronic acid Mn~ ~48000-186000, containing 21.7% carboxyl groups by weight. |
| P2 | Pectic Acid - Fluka - poly D-galacturonic acid $M_n$ $(176.13)_n$~75% purity, containing 19.6% carboxyl groups by weight. |
| P3 | Xanthan Gum - a commercial polysaccharide of Xanthamonas campestris containing 6% carboxyl groups by weight. |
| P4 | Kelco K8A13 - A high molecular weight anionic heteropolysaccharide of formula $[C_{107}H_{158}O_{190}K_5]_n$, containing 5.7% carboxyl groups by weight. |

Example 1 illustrates the synthesis of the novel $R_f$ cationic/anionic polysaccharide complexes as well as the predicted one-to-one pairing of charges in the complex and the high attainable yields.

Examples 2 through 6 demonstrate the application of said complexes to the improvement of fire-fighting foams.

Examples 7 and 8 demonstrate that further improvement of foam life can be obtained by the use of fluorochemical oligomer additives with the R-cationic/anionic polysaccharide complexes.

Examples 9–25 demonstrate that numerous other fluorinated cationic surfactants and anionic polysaccharides can be used, optionally with fluorinated oligomers, to prepare compositions in accord with this invention.

Example 26 indicates the improved fire-test performance that can be realized by these teachings.

EXAMPLE 1

Anionic polysaccharides were reacted with $R_f$-cationic surfactants to yield insoluble complexes of the predicted one-to-one anionic to cationic charge stoichiometry.

The elemental analysis of the complexes support this prediction, as shown in Table 5. When the % F, % N, or % S contents are used to calculate the proportions of surfactant and polysaccharide in the complexes, and this ratio compared to the known density of carboxyl sites on the polysaccharide (determined for each polysaccharide by perchloric acid titration), it is seen that the anionic sites are on the average ~90% saturated with fluorosurfactant cations (the remaining unreacted sites being paired with a simple inorganic counterion). The organic cationic/anionic ratio of each complex is expressed as "% Binding." Also given is the % yield of each precipitation: these were surprisingly high, arough 85% on the average (based on 1 g polysaccharide +weight of surfactant corresponding to the complex's % F).

EXAMPLE 2

This example shows that the addition of either a cationic or anionic fluorosurfactant to a polysaccharide improves QDT, but more so with a cationic surfactant.

| Polysaccharide-[a] $R_f$-Surfactant | % F[b] | Flocculation[c] | FXR | QDT (Min) |
|---|---|---|---|---|
| P4: - | 0.0 | none | 6.3 | 9.7 |
| P3: B5 | 0.1 | none | 5.7 | 12.8 |
| P3: A10 | 0.1 | high | 5.9 | 15.6 |
| P3: B2 | 0.1 | none | 5.9 | 13.3 |
| P3: A21 | 0.1 | slight | 5.9 | 19.3 |

[a]The basic ARC composition is 1% polysaccharide, 5% $B_6$, 10% butyl carbitol
[b]% F in the concentrate
[c]6% concentrate in a tap water solution
NOTE: These footnotes are also applicable to succeeding Examples 3–8.

TABLE 5

ANALYSIS OF COMPLEXES OF ANIONIC POLYSACCHARIDES AND CATIONIC FLUOROSURFACTANTS

| Complex Polysaccharide: Cationic $R_f$ Surf. | % F | % S | % N | Binding[a] (%) | Yield[b] (%) |
|---|---|---|---|---|---|
| P3: A9 | 18.1 | 2.3(2.4)[c] | 1.1(1.0)[c] | 87 | 90 |
| P3: A10 | 22.2 | 2.5(2.2) | 0.8(1.0) | 88 | 86 |
| P3: A21 | 22.1 | 2.3(2.2) | 1.2(1.0) | 84 | 83 |
| P4: A9 | 19.4 | 3.0(.6) | 0.9(1.1) | 102 | — |
| P4: A10 | 23.7 | 2.8(2.4) | 0.7(1.0) | 98 | 97 |
| P4: A21 | 22.2 | 2.8(2.2) | 0.8(1.0) | 86 | 90 |
| P4: A20 | 19.8 | 2.6(2.0) | 2.0(1.7) | 76 | 101 |
| P1: A9 | 32.3 | 4.8(4.3) | 1.9(1.9) | 85 | 56 |
| P2: A9 | 32.9 | 4.9(4.3) | 1.9(1.9) | 94 | 66 |

[a]Percent binding is defined as: amount of surfactant bound (based on % F)/amount of surfactant predicted to be bound based on the carboxylate contents.
[b]Percent yield is defined as: weight of collected precipitate/weight of precipitate predicted from the fluorine content of the complex.
[c]Numbers in parentheses are predicted values based on the theoretical mole ratio of this element to fluorine in the surfactant molecule.

EXAMPLE 3

This example shows that only cationic surfactants cause flocculation and the QDT is augmented by such flocculation.

| Polysaccharide-$R_f$-Surfactant | % F | Flocculation | FXR | QDT (Min) |
|---|---|---|---|---|
| P4: — | 0.0 | none | 6.3 | 9.7 |
| P4: B4 | 0.1 | none | — | — |
| P4: B1 | 0.1 | none | — | — |
| P4: C1 (Oligomer) | 0.1 | none | — | — |
| P4: C4 (Oligomer) | 0.1 | none | — | — |
| P4: B3 | 0.1 | none | 6.8 | 13.1 |
| P4: A9 | 0.1 | slight | 6.8 | 21.1 |

EXAMPLE 6

This example shows that certain anionic polysaccharides exhibit better performance than others even with identical cationic fluorsurfactants, particularly with regard to FL on isopropanol.

| Polysaccharide-$R_f$-Surfactant | % F | Flocculation | FXR | QDT (Min) | FL on IPA |
|---|---|---|---|---|---|
| P1: A10 | 0.1 | moderate | 7.3 | 3.2 | 0 |
| P3: A10 | 0.1 | high | 5.9 | 15.6 | 2 |
| P4: A10 | 0.1 | moderate | 6.0 | 19.0 | 32 |

EXAMPLE 7

This example demonstrates that a supporting oligomeric polymer additive can improve F1 on isopropanol for Polysaccharide P4 even with various fluorosurfactants which are ineffective alone.

| $R_f$-Ingredient Added to P4 | % F | $R_f$-Oligomer | Additive % | Total % F | FL on IPA (Min) |
|---|---|---|---|---|---|
| B4 | 0.10 | — | — | 0.10 | 0 |
| " | 0.09 | C4 | 0.01 | " | 4 |
| B1 | 0.10 | — | — | " | 3 |
| " | 0.09 | C4 | 0.01 | " | 6 |
| C1 (Oligomer) | 0.10 | — | — | " | 5 |
| " | 0.09 | C4 | 0.01 | " | 13 |
| A21 | 0.10 | — | — | " | 23 |
| " | 0.09 | C4 | 0.01 | " | 46 |
| A9 | 0.10 | — | — | " | 17 |

-continued

| $R_f$-Ingredient Added to P4 | % F | $R_f$-Oligomer | Additive % | Total % F | FL on IPA (Min) |
|---|---|---|---|---|---|
| " | 0.09 | C4 | 0.01 | " | 40 |

EXAMPLE 8

This example shows that whereas a select anionic polysaccharide and $R_f$- cationic surfactant afford good properties, the FL on isopropanol can be further improved by the use of a supporting oligomeric polymer.

| Polysaccharide $R_f$-Surfactant | % F | $R_f$-Oligomers | % F | Total % F | FL on IPA (Min) |
|---|---|---|---|---|---|
| P4: A9 | 0.10 | — | — | 0.1 | 17 |
| P4: A9 | 0.09 | C1 | 0.01 | 0.1 | 25 |
| P4: A9 | 0.09 | C2 | 0.01 | 0.1 | 32 |
| P4: A9 | 0.09 | C3 | 0.01 | 0.1 | 34 |
| P4: A9 | 0.09 | C4 | 0.01 | 0.1 | 40 |

EXAMPLES 9 to 25

Table 6 shows that Examples 9–25 can be prepared in a similar fashion to earlier examples. These complexes and optional oligomer components can be formulated into fire fighting agents to perform effectively within the context of this patent.

TABLE 6

OTHER COMPLEXES USEFUL FOR FIRE-FIGHTING

| Example Number | Polysaccharide Component | Cationic Fluorochemical Component | Oligomer Component |
|---|---|---|---|
| 9 | P4 | A1 | — |
| 10 | P4 | A2 | C3 |
| 11 | P4 | A3 | — |
| 12 | P4 | A4 | — |
| 13 | P4 | A5 | C3 |
| 14 | P4 | A6 | — |
| 15 | P4 | A7 | C4 |
| 16 | P4 | A8 | C4 |
| 17 | P4 | A11 | C4 |
| 18 | P4 | A12 | — |
| 19 | P4 | A13 | C4 |
| 20 | P4 | A14 | — |
| 21 | P3 | A15 | C4 |
| 22 | P4 | A16 | C4 |
| 23 | P4 | A17 | C4 |
| 24 | P4 | A18 | — |
| 25 | P4 | A19 | — |

EXAMPLE 26

A formulation comprised of an anionic polysaccharide complex prepared in-situ, oligomer additives, surfactants and solvent was prepared as a concentrate and tested at 6% dilution in tap water in accordance with UL Specification 162, Standard for Foam Equipment and Liquid Concentrates, Underwriters Laboratories, Inc.

| FORMULATION (% ACTIVES) | |
|---|---|
| C1 | 0.75% |
| B5 | 0.50% |
| A9 | 0.30% |
| C4 | 0.40% |
| B7 | 1.20% |
| B9 | 0.35% |
| B10 | 0.50% |
| P4 | 0.70% |

-continued

| | |
|---|---|
| Butyl Carbitol | 14.0% |
| Water | Remainder |
| Fire Test Results - Type II (isopropanol) | |
| Control Time | 60 sec. |
| Extinguishing Time | 165 sec. |
| 20% Burnback | 13.3 min |
| Foam Expansion | 5.6 |
| Drain Time | 24.8 min |

EXAMPLE 4

This example shows that though any cationic fluorosurfactant is capable of improving FL on isopropanol, a cationic hydrocarbon surfactant is not useful.

| Polysaccharide $R_f$-Surfactant | % F | Flocculation | FXR | QDT | FL on IPA (Min) |
|---|---|---|---|---|---|
| P4: | 0 | none | 6.3 | 9.7 | 0 |
| P4: B8 | 0.2 | moderate | 5.7 | 10.0 | 0 |
| P4: A21 | 0.1 | moderate | 6.3 | 20.5 | 23 |
| P4: A9 | 0.1 | slight | 6.8 | 21.1 | 17 |
| P4: A10 | 0.1 | moderate | 6.0 | 19.0 | 32 |
| P4: A20 | 0.1 | slight | 6.9 | 16.9 | 9 |
| P4: A15 | 0.1 | moderate | 7.1 | 18.9 | 23 |

*Actives

EXAMPLE 5

This example shows the effect of increasing the fluorochemical actives. When the concentration is doubled, flocculatoin is increased with the cationic fluorosurfactant and QDT and FL on isopropanol are more rapidly improved in the system with the complex.

| Polysaccharide $R_f$-Surfactant | % F | Flocculation | FXR | QDT | FL on IPA (Min) |
|---|---|---|---|---|---|
| P4: B3 | 0.1 | none | 6.8 | 13.1 | 10 |
| P4: A20 | 0.1 | slight | 6.9 | 16.9 | 9 |
| P4: B3 | 0.2 | none | 6.8 | 14.3 | 14 |
| P4: A20 | 0.2 | moderate | 6.4 | 23.6 | 17 |

What is claimed is:

1. A complex of an anionic polysaccharide and a perfluoroalkyl surfactant cation, wherein the perfluoroalkyl surfactant cation is of the formula $$R_f-\overset{\oplus}{A}NR_1R_2R_3 \qquad (I)$$

wherein $R_f$ represents a straight or branched chain perfluoroalkyl or perfluoroalkoxy-substituted perfluoroalkyl of 4 to 18 carbon atoms;

A represents a divalent covalent linking group;

$R_1$, $R_2$ and $R_3$ are independently hydrogen, aryl of 6 to 10 carbon atoms or an aliphatic or araliphatic group of up to 50 carbon atoms;

$R_1$ and $R_2$ taken together with the nitrogen to which they are attached represent piperidino, morpholino, or piperazino; or wherein $R_1$, $R_2$ and $R_3$ taken together with the nitrogen to which they are attached represent pyridinium, or substituted pyridinium,

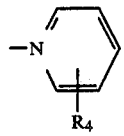

where $R_4$ is hydrogen or alkyl of up to 1 to 4 carbon atoms.

2. An aqueous fire fighting composition containing (a) an effective amount of a complex according to claim 1 for extinguishing polar solvent fires; and (b) aqueous fire fighting foam adjuvants.

3. A method of extinguishing a polar solvent fire comprising applying to the surface of said solvent an effective amount of a composition according to claim 2 for extinguishing said fire.

4. A complex according to claim 1, wherein the cation is a perfluoroalkyl containing ammonium group.

5. A complex according to claim 1, wherein the anionic polysaccharide contains acidic carboxyl, sulfonato, sulfato, or phosphato groups.

6. A complex according to claim 1, wherein $R_f$ is perfluoroalkyl of 4 to 12 carbon atoms.

7. A complex according to claim 6, wherein A is a divalent covalent linking group of up to 20 carbon atoms of the formula $$-(G)_{n1}\text{-alkylene}(G'\text{-alkylene})_{n2}(G''\text{-alkylene})_{n3}$$

wherein

G, G' and G'' independently represent —O—, —S—, $-SO_2-$, $-SO_2NH-$, $$-CONH-,\ -\overset{O}{\overset{\|}{C}}-,\ -\overset{OH}{\overset{|}{C}}H;\ -C-CH_2OH$$

n1 is 0 or 1;

n2 and n3 are independently 0, 1 or 2;

alkylene is straight or branched chain alkylene of 1 to 8 carbon atoms, and A additionally represents a direct bond; and $R_1$, $R_2$, and $R_3$ are lower alkyl.

8. A complex according to claim 7 wherein A is of the formula $$-CH_2CH_2-S\text{-alkylene-}G'\text{-alkylene-}$$

wherein G' is $$-\overset{OH}{\overset{|}{C}}H- \text{ or } -\overset{|}{C}-CH_2OH$$

and alkylene is straight or branched chain of from 1 to 6 carbon atoms, $R_1$, $R_2$, $R_3$ are methyl.

* * * * *